United States Patent [19]

Schumacher et al.

[11] 3,963,319

[45] June 15, 1976

[54] COAXIAL RIBBON CABLE TERMINATOR

[75] Inventors: William Ludlow Schumacher, Camp Hill; Robert Volinskie, Hershey, both of Pa.

[73] Assignee: AMP Incorporated, Harrisburg, Pa.

[22] Filed: Dec. 12, 1974

[21] Appl. No.: 532,076

[52] U.S. Cl. ..... 339/176 MF; 339/17 F; 339/99 R; 339/176 MP

[51] Int. Cl.[2] ..... H01R 11/20

[58] Field of Search ..... 339/17 C, 17 F, 98, 339/99 R, 176 MF, 176 MP

[56] References Cited

UNITED STATES PATENTS

| | | | |
|---|---|---|---|
| 3,309,645 | 3/1967 | Noschese | 339/98 |
| 3,444,506 | 5/1969 | Wedekind | 339/99 R |
| 3,524,161 | 8/1970 | Frantz | 339/176 MP |
| 3,680,032 | 7/1972 | Mosier | 339/99 R |
| 3,816,818 | 6/1974 | Meier | 339/99 R |
| 3,864,011 | 2/1975 | Huber | 339/176 MF |

FOREIGN PATENTS OR APPLICATIONS

| | | | |
|---|---|---|---|
| 1,293,267 | 4/1969 | Germany | 339/17 C |

*Primary Examiner*—Roy Lake
*Assistant Examiner*—Mark S. Bicks
*Attorney, Agent, or Firm*—Allan B. Osborne

[57] ABSTRACT

This invention relates to a device for terminating coaxial ribbon cable to a paddle card, printed circuit board ("PCB") or the like. More particularly, the invention includes an insulating housing having a plurality of spaced openings each containing a terminal. The contact members on one end of the terminals extend upwardly and receive bared wires extending across the housing through slots in the vertical front and rear walls. The pins on the opposite side of the terminals are soldered to the paddle card or PCB.

1 Claim, 5 Drawing Figures

COAXIAL RIBBON CABLE TERMINATOR

BACKGROUND OF THE INVENTION

Coaxial cable is cable having a center conductor or wire for carrying a RF signal and an outer conductor for shielding the center conductor from outside interference. Insultaion, generally referred to as dielectric, separate the center and outer conductor. An insulating jacket surrounds the outer conductor. The outer conductor may be braided metallic wire or it may be foil wrapped around the dielectric. In the latter case, a drain wire, in direct intimate contact with the foil and parallelling the center wire, provides a convenient means for terminating the foil shielding.

A coaxial ribbon cable consists of a plurality of coaxial cable, all of which share a common outer insulating jacket. As implied by the term "ribbon", the several cables are lying in a flat plane.

The coaxial ribbon cable for which the terminator of the present invention was developed is the foil wrapped-parallel drain wire type. This type of cable is disclosed in U.S. Pat. No. 3,775,552.

An obvious problem one encounters in attaching a coaxial ribbon cable to a paddle card, PCB and the like, hereinafter collectively referred to as a "board", is the manipulation of the many small center wires and drain wires. The least practical but currently most prevalent method for attachment is by soldering the individual wires to terminals fixed in the board. The drawbacks to this mehtod is the expense involved in labor and the inherent problem of effecting cold solder joints. Another problem, related to expense also, is that it takes a considerable amount of time to terminate one coaxial ribbon cable. Still another problem is that the coaxial ribbon cable so terminated can be removed from the board only with difficulty and sometimes with damage to adjacent components on the board and further to the board itself.

Accordingly the object of the present invention is to provide a device which overcomes the above and other problems economically and uncomplicated.

DESCRIPTION OF THE PREFERRED EMBODIMENT

Figure 1:
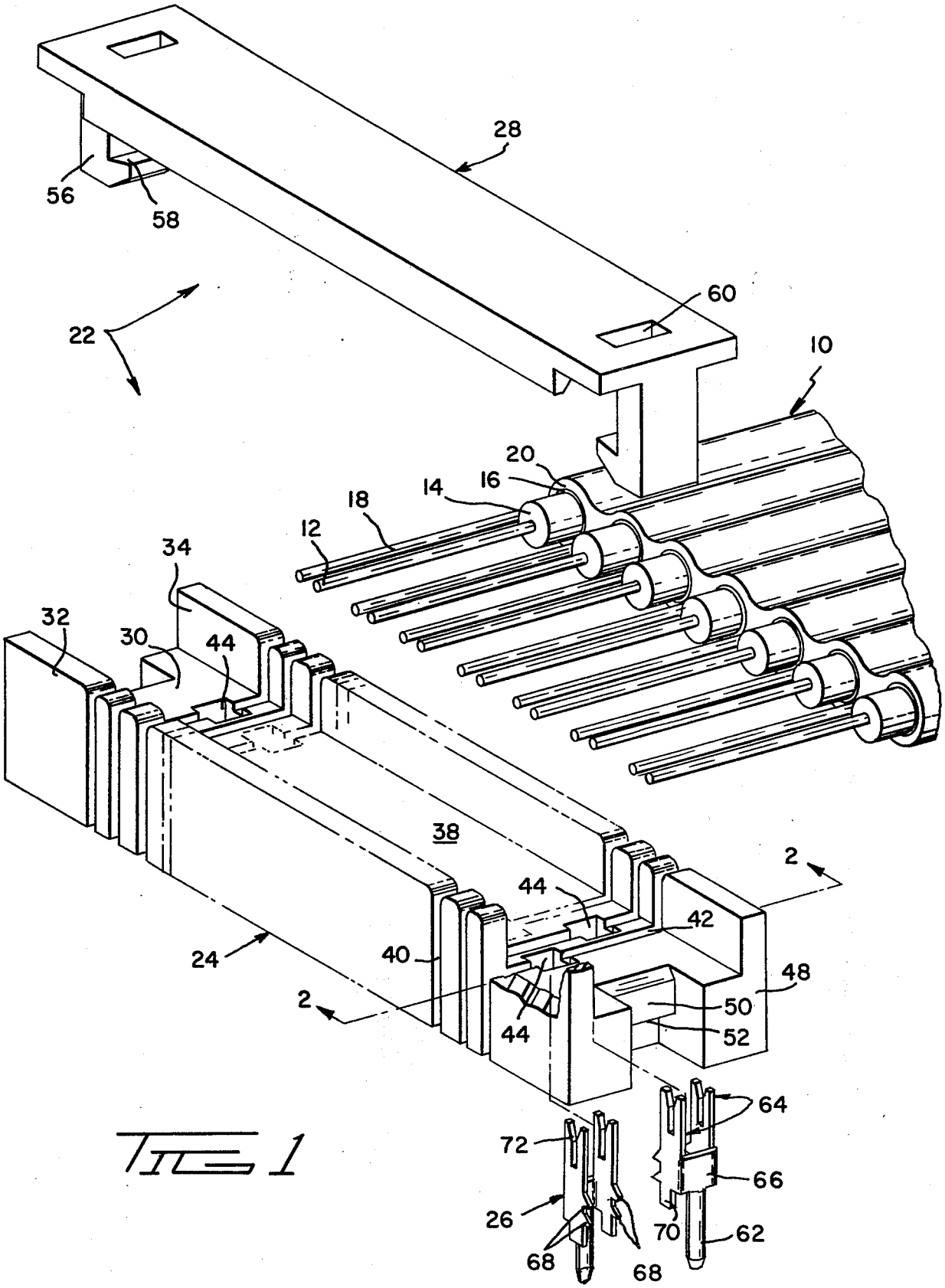
FIG. 1 is an exploded perspective view of the coaxial ribbon cable terminator constructed in accordance with the preferred embodiment of the present invention.

A coaxial ribbon cable 10 is seen entering FIG. 1 from the right. A center wire 12 protrudes from dielectric 14 around which foil 16 is wrapped. Drain wire 18, in intimate contact with foil 16, parallels center wire 12. These four elements comprise an individual coaxial cable without an outer insulating jacket. An outer insulating jacket 20 is common to the plurality of individual coaxial cables. Ribbon cable 10 has been prepared for terminating by removing dielectric 14, foil 16 and jacket 20 to bare a length of center wire 12 and drain wire 18.

The device for terminating coaxial ribbon cable 10, terminator 22, includes a housing 24, a plurality of terminals 26 and a cover 28. Housing 24 and its cover are preferably made from flame retardant nylon. Other insulating materials may also be used.

Figure 2:
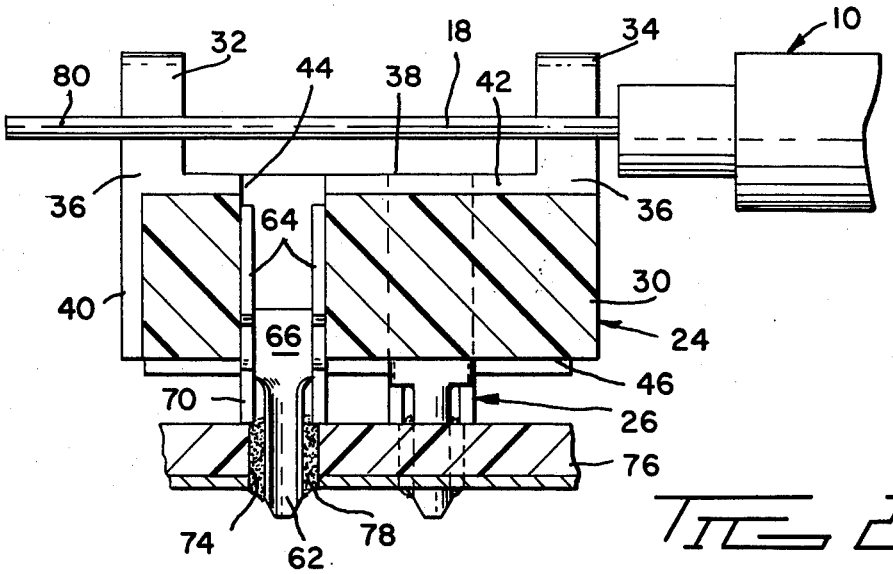
FIGS. 2–4 illustrate the stages of terminating a coaxial ribbon cable into the terminator of FIG. 1, the three views being along lines 2—2 of FIG. 1.

Referring now to both FIGS. 1 and 2, housing 24, viewed from an end, is U-shaped, having a base 30 of substantial thickness and front and rear vertical walls 32–34 respectively.

Each of the walls have a plurality of slots 36 extending from the top downwardly to the upper surface 38 of base 30. From there down to the bottom of the housing on front wall 32 only, these slots continue as grooves 40. FIGS. 2–5 illustrate this structure plainly. The slots serve primarily to isolate one wire from its neighbor.

Base grooves 42 extend across upper surface 38, in line with and connecting slots 36 located in the front and rear walls 32 and 34.

Base 30 contains a plurality of openings 44 which extend from top to bottom of the base and open out onto the faces of both top and bottom surfaces 38 and 46 respectively. Openings 44 are generally square on a horizontal plane and are located in base 30 in a staggered pattern with an opening intersecting a base groove 42. The staggered pattern accommodates small horizontal distances between adjacent center conductors 12 and drain wires 18. Other than the intersection with base grooves 42 the walls of openings 44 are smooth.

Both sidewalls 48 of housing 24 have a notch 50 and an undercut to define a downwardly facing shoulder 52. The interior wall of notch 50 has been beveled as indicated by reference numeral 54 to facilitate camming the cover lock.

Cover 28 is sized to fit between front and rear walls 32–34, and extends across the base from side-to-side. A cover lock 56 depending from either side of the cover contains a ledge or upwardly facing shoulder 58. Shoulder 58 engages downwardly facing shoulder 52 on base 30 to lock the cover onto the base.

Windows 60, located in cover 28 in overlying alignment with shoulders 58 provides an opening for inserting a screwdriver blade or the like for flexing cover locks 56 outwardly thereby releasing the cover from the base.

Terminals 26, stamped and formed from beryllium copper or like metal, have a depending pin 62 and upwardly extending redundant contact members 64. Intermediate the contact members and pin, the body 66 of the terminal contains two pair of locking lances 68 and a pair of depending stops 70.

Pins 62 may be semi-round to provide stronger support and to improve solderability.

Contact members, or simply "contacts" 64, consist of two flats bent about 90 degrees relative to pin 62 with wire-receiving, U-shaped slots 72 cut downwardly into each flat. Terminals having one contact member and one slot 72 (not shown) could be provided; however, the redundancy of the preferred embodiment provides both electrical termination and strain relief.

The size of the redundant contacts and body 66, as defined by the perimeter, is such as to fit into an opening 44 in base 30 with lances 68 biting into its walls.

The method of terminating coaxial ribbon cable 10 involves the use of a pair of crimping dies and means for moving the dies toward each other with housing 24 thereinbetween. Prior to that point in the assembly, terminals 26 are pushed up into each opening 44, contacts 64 head first, to a point where contact heads 64 are flush with surface 38. The interferences between lances 68 and the walls of the opening prevent the terminals from falling out. The partial assembly may then be mounted with pins 62 protruding through holes 74 on board 76 as FIG. 2 shows. The current conventional method of securing the pins to the board is by soldering, such being indicated by reference numeral 78. The housing 24 is positioned away from the board by stops 70.

Following soldering and clean-up, bared center wires 12 and drain wires 18 are combed into and pushed down slots 36 in front and rear walls 32 and 34 with the free ends 80 protruding beyond front wall 32 as FIG. 2 shows.

Figure 3:
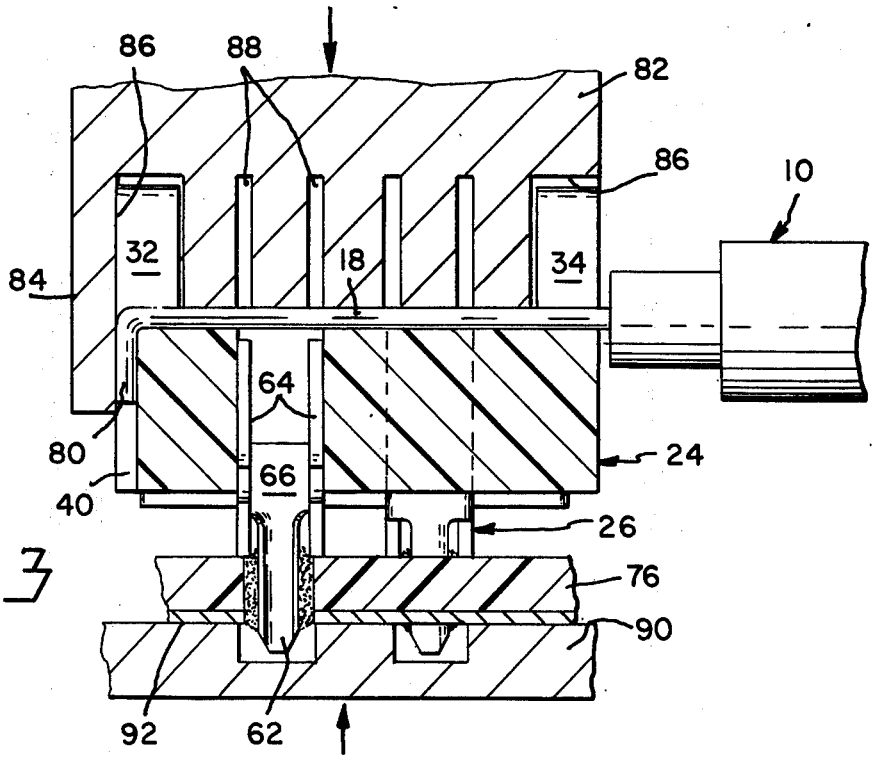

FIG. 3 shows an upper die 82 after it has been pushed down onto housing 24. As it is moved down, its leading edge 84 contacted and bent the free ends 80 of the wires down into grooves 40. In addition to leading edge 84, upper die 82 has recesses 86 so as to clear the front and rear walls 32–34 and internal recesses 88 to give sliding room to contacts 64.

Lower die 90 which abuts the lower surface 92 of board 76 contains recesses to give clearance to the ends of pins 62 sticking down below the board. Lower die 90 can also be flat in structure if it is made from a resilient material, such as rubber, that will give way and support contacts and board.

Figure 4:
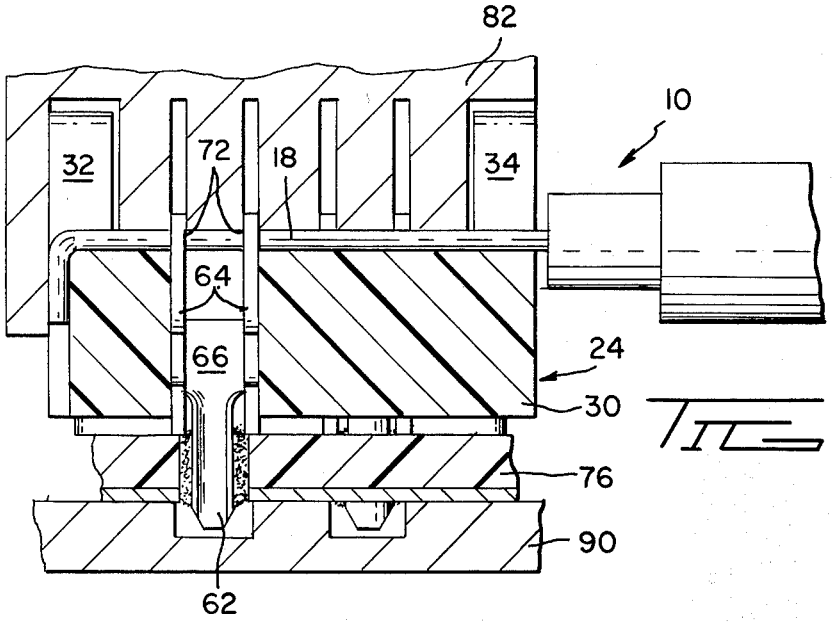

FIG. 4 illustrates the point of assembly where the dies, moving toward one another, forced housing 24 downwardly completely onto terminals 26. As the housing slides downwardly, the wires 12 and 18 are forced into the U-shaped slots 72 in the redundant contacts 64 in their respective terminals, thereby being electrically terminated and mechanically retained.

Figure 5:
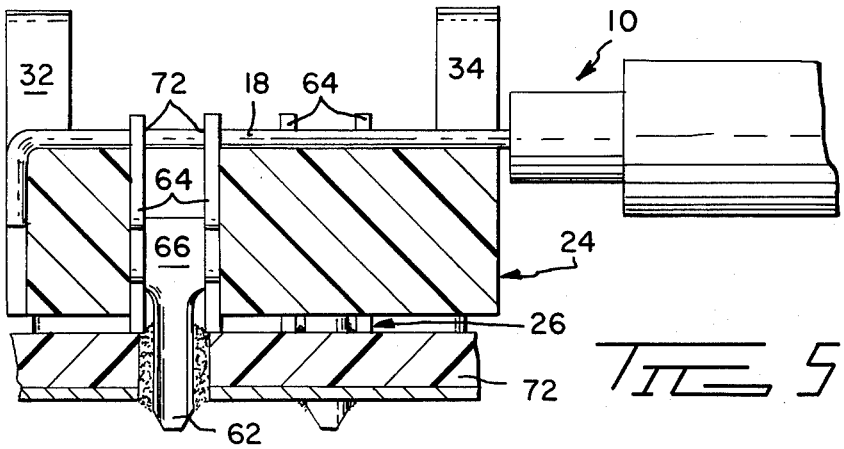
FIG. 5, also being along lines 2—2 of FIG. 1, illustrates the completed termination of the coaxial ribbon cable into the terminator of FIG. 1.

FIG. 5 illustrates the completed termination except for placing cover 28 on housing 24.

Whereas the preferred embodiment discloses two walls, the front and rear, a housing without walls or with just one wall could be provided. Likewise the base grooves could be eliminated or, in the alternative, the cover could be grooved.

The foregoing detailed description has been given for clearness of understanding only, and no unnecessary limitations should be understood therefrom, as some modifications will be obvious to those skilled in the art.

We claim:

1. A device for terminating cable of the type having a plurality of parallel wires, which comprises:

a. a housing consisting of front and rear upright walls bracketing a base member, and a plurality of spaced, parallel grooves extending through the walls and across the upper surface of the base member, further the base member having a plurality of spaced openings extending vertically therethrough with each opening intersecting a groove; and b. a plurality of contact terminals adapted to be positioned in the spaced openings, each terminal having at its lower end a pin adapted to depend from the base for insertion into a printed circuit board or the like, and at its upper end a pair of spaced slotted contact members adapted to extend above the upper surface of the base member and to receive and terminate a wire which may be lying in the groove intersected by the opening, and intermediate the two ends a pair of spaced parallel walls joined on one side by a strip of material integral to the walls and having on each of the two free sides a pair of laterally projecting lances, one over the other, said lances adapted to interfere with the walls of the opening to secure the terminal when such is positioned therein.

* * * * *